US007314024B2

(12) United States Patent
Ayme et al.

(10) Patent No.: US 7,314,024 B2
(45) Date of Patent: Jan. 1, 2008

(54) STEAM GENERATOR COMPRISING AN EMERGENCY FEED WATER DEVICE

(75) Inventors: Henri Ayme, Suresnes (FR); Gille Dague, Paris (FR)

(73) Assignee: Framatome ANP, Courbevoie (FR)

( * ) Notice: Subject to any disclaimer, the term of this patent is extended or adjusted under 35 U.S.C. 154(b) by 806 days.

(21) Appl. No.: 10/806,290

(22) Filed: Mar. 23, 2004

(65) Prior Publication Data

US 2005/0183675 A1 Aug. 25, 2005

(30) Foreign Application Priority Data

Mar. 31, 2003 (FR) ..... 03 03964

(51) Int. Cl.
*F22G 5/12* (2006.01)

(52) U.S. Cl. ..... 122/487; 122/32

(58) Field of Classification Search ..... 122/32, 122/459, 466, 487, 504
See application file for complete search history.

(56) References Cited

U.S. PATENT DOCUMENTS 3,923,007 A 12/1975 Schroeder
3,938,473 A 2/1976 Mayer et al.
5,083,529 A * 1/1992 Sundheimer ..... 122/32
5,110,538 A 5/1992 Pascal et al.
5,335,629 A 8/1994 Cornic
5,347,959 A * 9/1994 Slama et al. ..... 122/32
6,173,680 B1 * 1/2001 Dague et al. ..... 122/441

FOREIGN PATENT DOCUMENTS

FR 2 387 417 11/1978

OTHER PUBLICATIONS

French Search Report, dated Nov. 5, 2003, French Patent Office.

* cited by examiner

*Primary Examiner*—Gregory Wilson
(74) *Attorney, Agent, or Firm*—Connolly Bove Lodge & Hutz LLP

(57) ABSTRACT

The steam generator (1) comprises a first normal feed water device (8) and a second emergency feed water device (16) of the steam generator, comprising, respectively, a first toroidal header (10) and a second toroidal header (17) arranged coaxially with respect to the outer jacket (2*b*) of the steam generator. The second toroidal header (17) of the second emergency feed water device (16) placed inside the upper cylindrical part (2*b*) of the outer jacket comprises, fastened to each of a set of openings penetrating an upper part of its toroidal wall, a water injection tube (22) having an open lower end part fastened to the opening of the toroidal wall, a straight part inclined with respect to the vertical axial direction in the direction of a central part of the steam generator and an open upper end at the end of the straight part of the tube (22) for injecting emergency water inside the steam generator.

8 Claims, 7 Drawing Sheets

STEAM GENERATOR COMPRISING AN EMERGENCY FEED WATER DEVICE

The invention relates to a steam generator and especially to a steam generator of a pressurized-water-cooled nuclear reactor comprising an emergency feed water device.

Steam generators such as steam generators of pressurized-water-cooled nuclear rectors comprise an outer jacket of generally cylindrical shape arranged vertically in the building of the nuclear reactor, that is to say with the axis of the outer jacket vertical.

The steam generators of pressurized-water nuclear reactors enable the feed water to be heated and vaporized by heat exchange with the pressurized cooling water of the nuclear reactor, forming the primary heat exchange fluid which flows inside tubes of an exchange bundle. The tube bundle is arranged inside a bundle wrapper of generally cylindrical shape which is arranged coaxially inside the outer jacket.

The outer jacket of the steam generator generally comprises a lower cylindrical part containing the bundle of heat exchange tubes arranged inside the bundle wrapper, an upper cylindrical part having a diameter greater than the diameter of the lower part in particular containing separators and steam dryers and a part with a frustoconical junction between the lower part and the upper part of the outer jacket.

Steam generator feed water is introduced into the outer jacket and channelled, so as to enter the exchange bundle, at the lower part of the bundle and of the bundle wrapper. The feed water then flows from the bottom upwards inside the bundle wrapper in contact with the outer surface of the tubes, such that it is heated then evaporates and is in the form of steam in the upper part of the outer jacket of the steam generator. The steam recovered in the upper part is separated from the water droplets that it may contain and dried then sent to the reactor turbine.

The feed water is generally introduced in the upper part of an annular space made between the tube bundle wrapper and the outer jacket of the steam generator or a skirt for guiding the feed water and flows in the annular space to the lower part of the bundle. The annular space communicates, at its lower part, with the inner space of the bundle wrapper containing the tube bundle.

To obtain good efficiency of the steam generator and satisfactory operating conditions, it is necessary to distribute the feed water stream over the circumferential direction of the annular feed space of the steam generator. To do this, the feed water device of the steam generator comprises a header having a wall of generally toroidal shape which is placed inside the outer jacket of the steam generator, in a coaxial arrangement, vertically in line with the upper part of the annular feed water space. The header is connected to a feed water pipe penetrating the outer jacket of the steam generator and its wall comprises a plurality of openings in its upper part which are distributed over the periphery of the header and associated with means making it possible to direct the feed water to the upper part of the annular feed space of the steam generator.

During normal operation of the steam generator, feed water is sent continuously and with a substantially constant flow rate to the lower part of the tube bundle, and the flow of feed water, which is heated then vaporized on contact with the tubes of the bundle, cools the pressurized water flowing in the tubes constituting the primary fluid of the nuclear reactor.

In the case of degraded operation of the secondary feed water circuit of the steam generator, the feed water flow rate provided by the feed water device with a toroidal header may become insufficient, irregular, or may even be interrupted.

In this case, it is necessary to provide the steam generator, in a very short time, with emergency water making it possible to compensate for an insufficient or zero flow rate of the normal feed device of the steam generator.

To do this, it has been proposed to use an emergency feed water device for the steam generator which has a structure similar to the normal feed device. Such an emergency feed water device for the steam generator comprises a header having a toroidal wall which is placed above the annular feed space of the steam generator and which comprises a plurality of openings in the upper part of the toroidal wall, in order to distribute the water. The emergency water distribution header may be placed above or below the toroidal-walled header of the normal feed device.

A drawback of this arrangement is that the emergency water of the steam generator coming from a water reserve connected to the toroidal header which is at a fairly low temperature, for example 7° C., is brought into contact with the outer wall of the steam generator which is at a temperature of about 290° C. to 300° C. in the upper part of the steam generator, before the emergency water has been able to be heated inside the steam generator. This may result in thermal shock which can be damaging for the structure of the steam generator.

The aim of the invention is therefore to provide a steam generator comprising an outer jacket of generally cylindrical shape arranged with its vertical axis having a lower cylindrical part containing a bundle of heat exchange tubes connected to a primary fluid circuit and arranged in a bundle wrapper which is substantially coaxial with the outer jacket, an upper cylindrical part having a diameter greater than the diameter of the lower part in particular containing separators and steam dryers and a part with a frustoconical junction between the lower part and the upper part of the outer jacket, at least a first and a second device for supplying feed water to an annular space between the bundle wrapper and one of a guide skirt and the outer jacket, via the upper part of the annular space which communicates with the inner space of the bundle wrapper at its lower part, each one comprising a feed water distribution header in the annular space arranged inside the outer jacket, having a toroidal wall substantially coaxial with the outer jacket and with the bundle wrapper, the toroidal wall being penetrated by a plurality of openings into its upper part and at least one feed water supply pipe in a space inside the toroidal wall of the header penetrating the outer wall of the steam generator, the first feed device being used during normal operation of the steam generator and the second feed device being used in order to feed the steam generator with emergency water, the emergency feed water of the steam generator being supplied without producing thermal shock, in particular on the outer jacket of the steam generator.

With this aim, the second toroidal header of the second emergency feed water device placed inside the upper part of the outer jacket comprises, fastened to each of its openings of its toroidal wall, a tube for injecting water having an open lower end part fastened to the opening of the toroidal wall, a straight part which is inclined with respect to the vertical axial direction in the direction of a central part of the steam generator and an upper end open at the end of the straight part of the tube for injecting emergency water inside the steam generator.

According to particular features of the invention:

the inclined straight part of each of the water injection tubes makes an angle α of between about 5° and about 20° and preferably an angle α of roughly 10° with the vertical axial direction;

the openings penetrating the wall of the second toroidal header of the second emergency feed water device are circular openings centred on a circle parallel to the toroidal header located close to the uppermost part of the wall of the toroidal header and that each of the emergency water injection tubes comprises a first portion and a second portion, the axes of which make a non-zero angle α between them, each of the emergency water injection tubes being fastened by one end of its first portion to an opening penetrating the wall of the second toroidal header;

each of the emergency water injection tubes in the steam generator comprises at least one support means such as a cleat for fastening the water injection tube by welding to the outer surface of the second toroidal header;

each of the water injection tubes comprises, in its lower end part fastened to the opening of the second toroidal header, a device for trapping debris;

the debris-trapping device consists of a circular plate having a diameter substantially equal to the inside diameter of the tube and penetrated by openings having a dimension less than a characteristic dimension of the debris which it is desired to trap;

the feed water supply pipe connected to the second header by means of a first end comprises a second opposite end connected, for example by welding, to a pipe penetrating the wall of the upper part of the steam generator; and the second toroidal header of the second emergency feed water device is supported, inside the upper part of the outer jacket of the steam generator, by at least three brackets fastened in radial arrangements over the inner surface of the upper part of the outer wall of the steam generator, by a first end and comprising a second end directed towards the central part of the outer jacket of the steam generator comprising a recess which is open in the direction of the central part of the outer jacket of the steam generator, a first arm defining a lower part of the recess and a second arm defining an upper part of the recess, a cavity being made in an inner face of the lower arm in order to accommodate a wedge for supporting the second toroidal header with a clearance in the vertical direction and in the radial horizontal direction of each of the support brackets.

In order for the invention to be better understood, a steam generator of a pressurized-water nuclear reactor made according to the invention will be described by way of example with reference to the appended figures.

Figure 1:
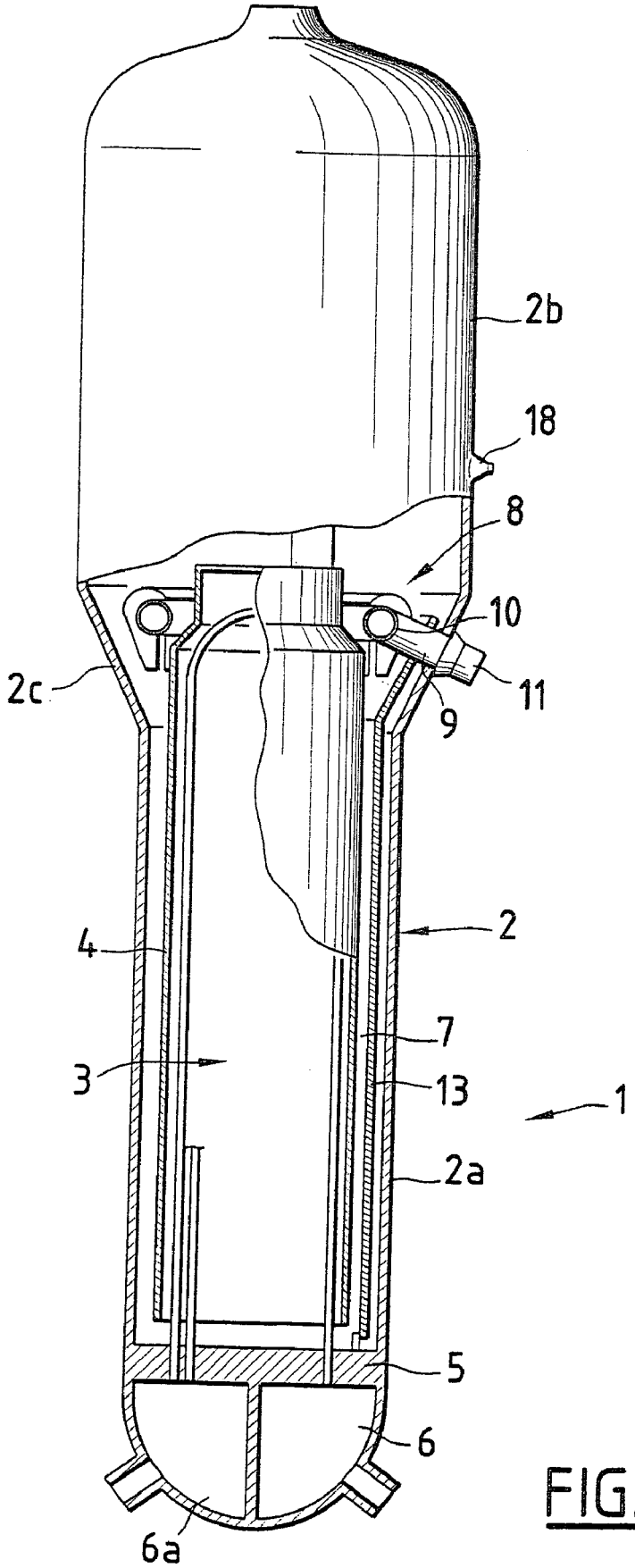
FIG. 1 is a view in elevation and in partial section of a steam generator of a pressurized-water-cooled nuclear rector.

FIG. 1 shows the steam generator 1 which comprises an outer jacket 2 of generally cylindrical shape comprising a lower cylindrical part 2*a* having a first diameter and an upper part 2*b* having a second diameter which is greater than the diameter of the part 2*a*, together with a frustoconical part 2*c* joining the lower part 2*a* of the outer jacket 2 of the steam generator to the upper part 2*b*.

Inside the lower part 2*a* of the smaller-diameter outer jacket 2 is placed the bundle 3 of the steam generator, inside a bundle wrapper 4 of overall cylindrical shape arranged coaxially inside the outer jacket 2 of the steam generator.

The tube bundle 3 consists of tubes folded into a U shape fastened at the lower end into a tube sheet 5 separating the inner space of the jacket 2 of the steam generator from a two 6 in parts making it possible to supply the tubes with primary water and to recover the primary water having flowed through the tubes.

Feed water is introduced inside the steam generator so that it can flow in contact with the tubes of the bundle 3 in the vertical direction from the bottom upwards, so as gradually to be heated and vaporized.

During normal operation of the steam generator, feed water is introduced by a feed device 8, in the upper part of an annular space 7 defined between the lower part 2*a* of the outer jacket of the steam generator or a guide skirt 13 and the bundle wrapper 4.

Above the tube sheet 5, the bundle wrapper 4 provides a passage for the feed water introduced in the upper part of the annular space 7 and reaching, by flowing in the vertical direction from the top downwards, the tube sheet 5. The feed water enters the bundle wrapper, thereby coming into contact with the tubes of the bundle 3 and flowing in contact with the bundle in the vertical direction and from the bottom upwards.

Heat exchange occurs between the primary water flowing in the tubes of the bundle 3 and the feed water flowing in contact with the outer surface of the tubes of the bundle 3.

The heated then vaporized feed water forms steam in the upper part of the bundle wrapper, the steam then being discharged inside the upper cylindrical part 2*b* of the steam generator containing separators and steam dryers.

According to a known arrangement, the normal feed water device of the steam generator, generally denoted by the reference 8, comprises a toroidal header 10 connected to a feed water supply pipe 9 in the toroidal header penetrating the outer jacket 2 of the steam generator inside a throughpipe 11. The normal feed water device 8 of the steam generator may advantageously be made as described and claimed in patent application No. 9805843 by Framatome.

The upper part of the wall of the toroidal header 10 which is arranged with its axis of revolution in the vertical direction and coincident with the axis of the outer jacket is penetrated by openings distributed over the circumference of the toroidal header 10.

Figure 2:
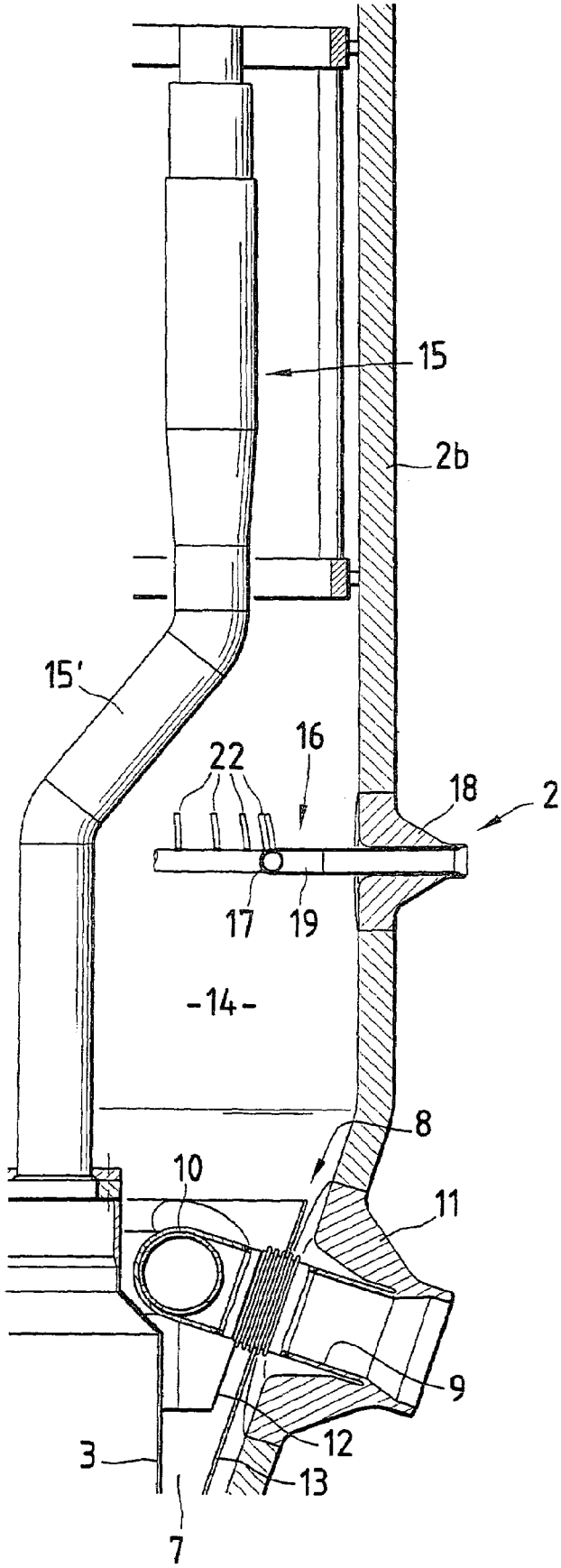
FIG. 2 is a half-view in section of an upper part of the steam generator at the headers of the feed water devices.

The main feed device 8, which is shown in FIGS. 1 and 2, comprises means for guiding the feed water coming from the toroidal header 10 and passing through the openings in the upper part of the jacket of the toroidal header. The means for guiding the feed water comprise a jacket 12 fastened around part of the header 10 having openings for passage of water. The jacket 12 of the guide means comprises an open lower part ensuring the feed water is guided and that it flows by gravity into the annular space 7. The guide means also comprise separating walls in a radial direction separating the space for flow of water inside the jacket 12, into a plurality of successive portions in the circumferential direction of the toroidal collector 10.

Preferably, the annular space 7 for supplying feed water to the inner space of the bundle wrapper of the steam generator may be defined between the bundle wrapper 3 and a guide skirt 13 of cylindro-frustoconical shape placed coaxially with the outer jacket 2 and with the bundle wrapper 3 of the steam generator.

The diameter of the toroidal header 10 is such that the openings for passage of feed water that are located in the upper part of the toroidal header on a parallel circle are arranged vertically in line with the entrance of the annular feed space 7, the feed water guide means 12 emerging at their lower part, between the flared part of the skirt 13 and the bundle wrapper 4, in a substantially centred position.

As can be seen in FIG. 2, inside the larger-diameter upper part 2*b* of the outer jacket 2 of the steam generator, are arranged means 15 for separating water droplets contained in the steam formed inside the bundle wrapper 4 in which the feed water flows from the bottom upwards thereby being heated and vaporized.

The separating devices 15 may advantageously consist of cyclone separators, which are each connected to the upper part of the bundle wrapper 4 by means of a steam pipe 15'.

Below the stage of the separators 15, the large-diameter upper part 2*b* of the outer jacket of the steam generator defines an inner space of the steam generator whose peripheral part 14 around the steam pipes 15 connected to the upper part of the bundle wrapper 4 is a completely free space.

For the embodiment shown, a second feed water device 16 constituting an emergency feed water device for the steam generator, is placed inside the space 14, above the main feed water device 8.

In other embodiments, the second feed device may be below the toroidal header.

Where the main supply of feed water provided by the main feed device 8 becomes insufficient, or where this supply is no longer guaranteed by the device 8, the emergency feed water device 16 may be controlled in order to provide continuity of supply of water from the steam generator and cooling of the steam generator.

The emergency feed water device 16 comprises a toroidal header 17 placed with its axis of revolution along the axis of the outer jacket of the steam generator, that is to say in a coaxial arrangement with respect to the toroidal header 10 of the main feed water device.

The mean diameter of the toroidal header 17, which is equal to the diameter of the parallel circle located on the upper part of the toroidal header 17, may be substantially greater than the mean diameter of the toroidal header 10, that is to say than the diameter of the parallel circle along which the openings for passage of water from the toroidal header are arranged.

The mean diameter of the toroidal header 17, which is generally between the inner diameter of the smaller-diameter lower part of the outer jacket 2 of the steam generator and the inner diameter of the larger-diameter upper part 2*b* may, for example, be equal to the inner diameter of the intermediate part 2*c* of the outer jacket 2 of the steam generator, at the axis of a pipe 11 penetrating the outer jacket 2 of the steam generator, to which the supply pipe 9 of the toroidal header 10 of the main feed water device of the steam generator is connected.

A pipe 18 penetrating the outer jacket 2 of the steam generator in its larger-diameter part 2*b*, at the toroidal header 17 of the emergency feed water device 16, makes it possible to provide emergency feed water coming from a reserve of water, from an emergency water supply pipe 19 inside the toroidal header 17 of the emergency feed device 16.

Figure 3A:
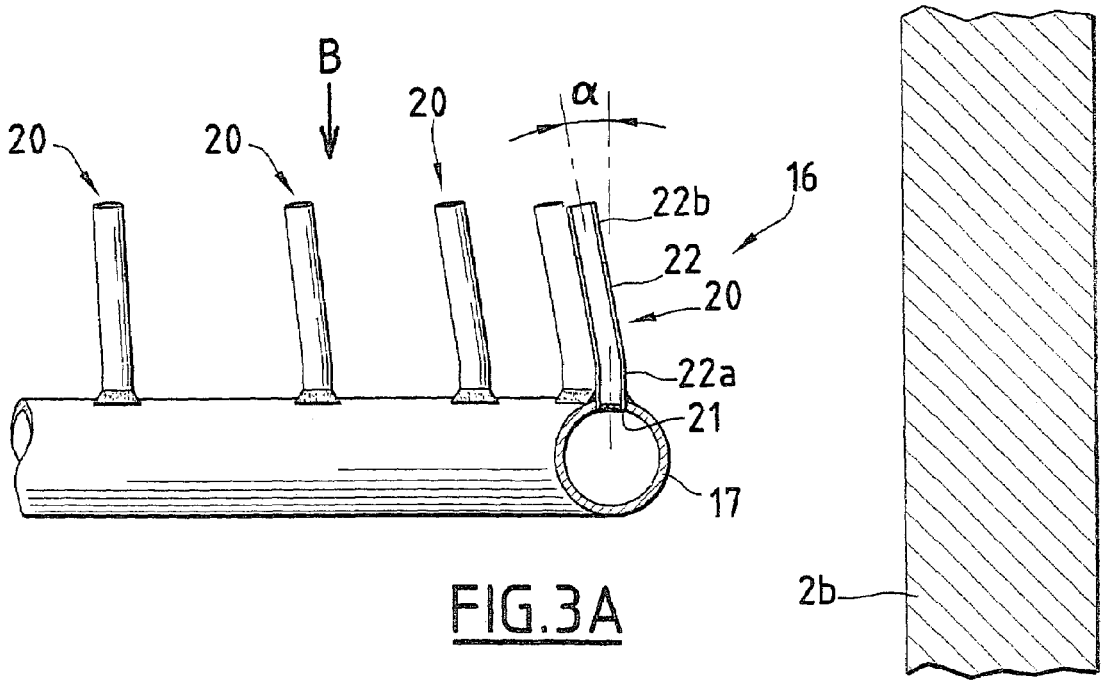
FIG. 3A is a view in enlarged section of part of the steam generator shown in FIG. 2, at the toroidal header for supplying emergency feed water.
Figure 3B:
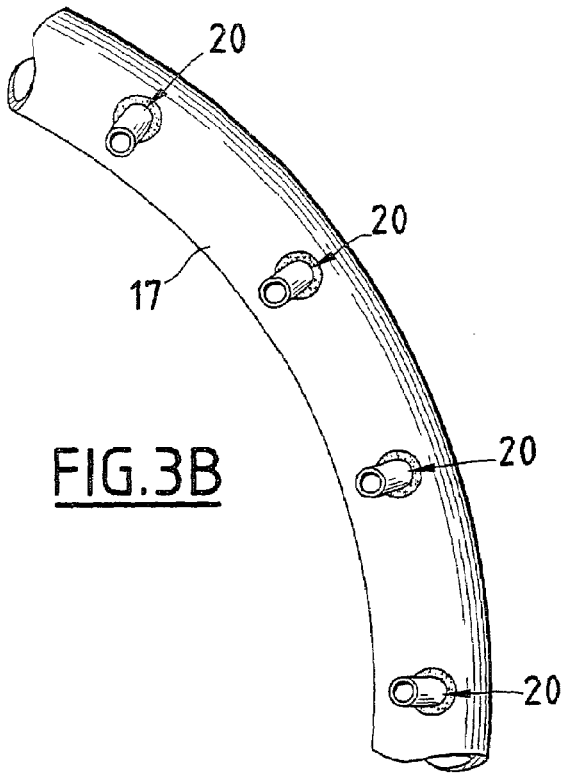
FIG. 3B is a top view of the toroidal collector along B of FIG. 3A.

As can be seen, in particular in FIGS. 3A and 3B, the emergency feed water device 16 comprises a plurality of water distribution devices 20 distributed over the circumferential direction of the upper part of the toroidal jacket 17.

The toroidal jacket 17 is penetrated by circular-shaped openings 21 for passage of water, the centres of which are arranged on the upper parallel circle of the toroidal header 17 whose diameter constitutes the mean diameter of the toroidal header. For example, in a preferred embodiment, fifty openings 21 are provided, distributed over the circumferential direction of the torus on the upper parallel circle. Each of the emergency water distribution devices 20 comprises, at an opening 21, a water injection tube 22 fastened in a sealed manner by welding to the wall of the toroidal header 17. Each of the water injection tubes 22, made for example by folding a straight tube, comprises a short first portion or lower portion 22*a* and a second portion or upper portion 22*b*, the length of which is greater than the length of the portion 22*a* and the axis of which makes an angle $\alpha$ with the axis of the first portion 22*a*.

Preferably, the angle $\alpha$ is between 5° and 20°, it being possible for this angle, for example, to be 10°.

The end of the lower portion 22*a* of each of the tubes 22 is fastened, along an opening 21, to the upper part of the wall of the toroidal header 17 in a direction parallel to the direction of the axis of revolution of the toroidal header 17, that is to say a vertical direction inside the steam generator in its service position.

The lower portion 22*a* of the tube 22 is fastened in the opening 21, in an orientation such that the upper part 22*b* is inclined with respect to the direction of the axis of revolution of the torus, in the direction of the central part of the steam generator.

Figure 6A:
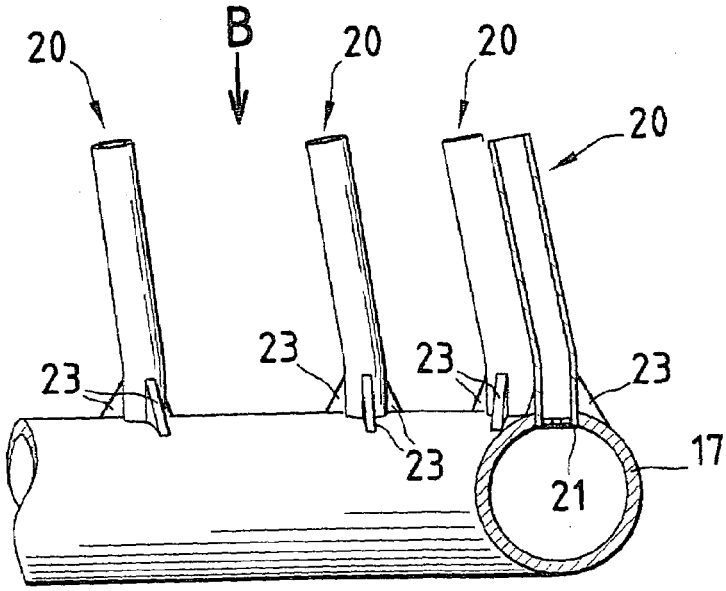
FIG. 6A is a view in vertical section of part of the toroidal collector and fastening means for the emergency water injection tubes.
Figure 6B:
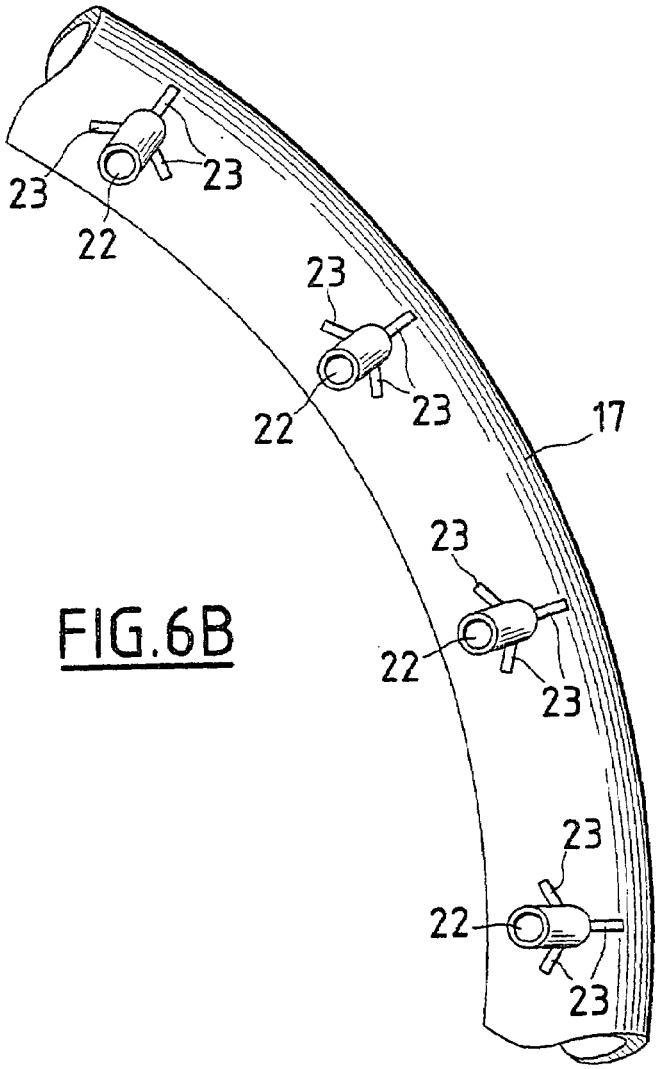
FIG. 6B is a top view along B of FIG. 6A of part of the toroidal header and fastening means for the emergency water injection tubes.

Preferably, as can be seen in FIGS. 6A and 6B, the tube 22 may not only be fastened by welding to the inside of the opening 21 but also fastened to the wall of the toroidal header 17 by support means 23, for example in the form of a cleat welded to the outer surface of the wall of the toroidal header 17 and to the lower portion 22*a* of the tube 22. Provision may be made, for example, of three support devices 23 for fastening each of the tubes 22 to the toroidal header 17.

Thus a strong fastening for the tube and high accuracy in orienting the axis of the upper part 22*b* of the tube 22 are provided.

Figure 7:
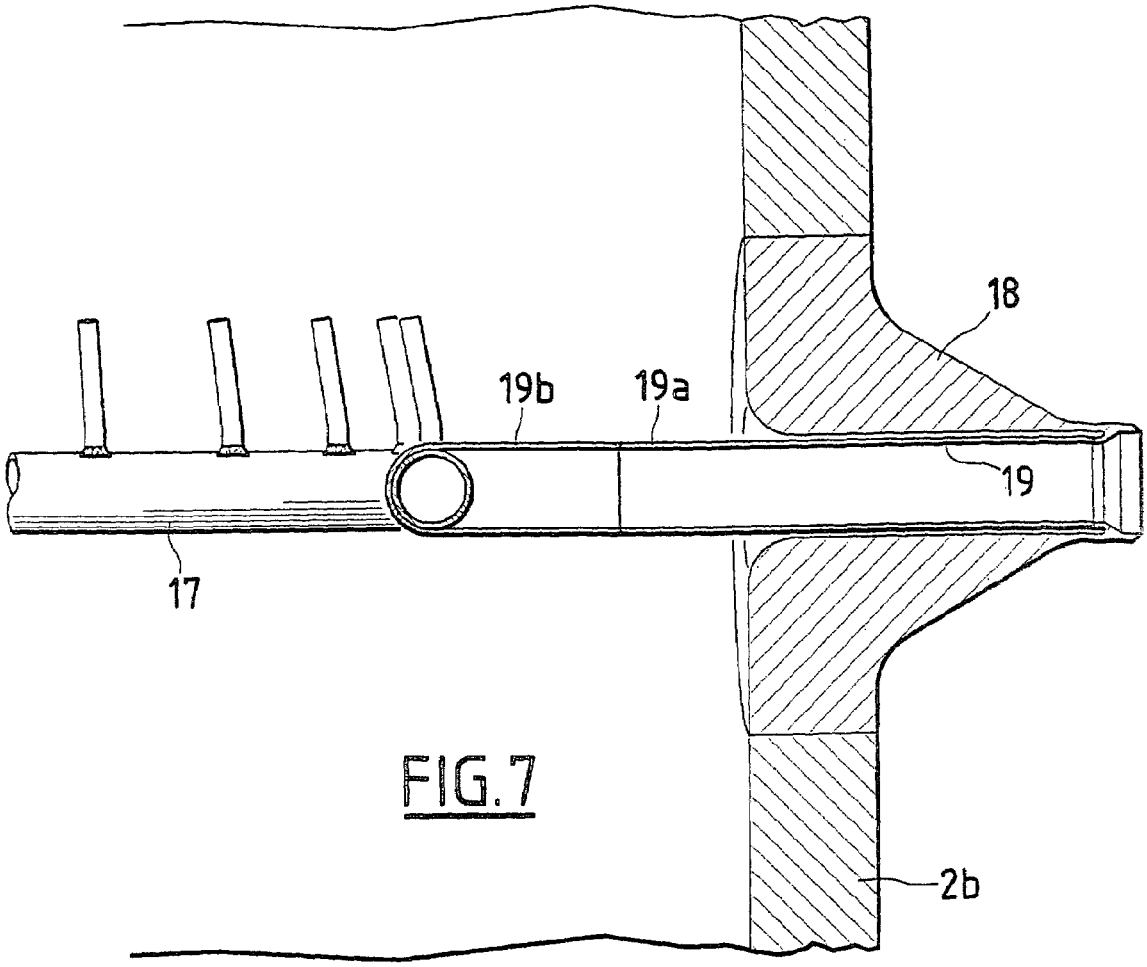
FIG. 7 is a sectional view of a feed water supply pipe in the toroidal header for supplying emergency feed water.

FIG. 7 shows the pipe 18 allowing the emergency water supply pipe 19 to pass through and be fastened to the toroidal header 17 of the emergency feed water device 16.

The supply pipe 19 comprises a sleeve 19*a* fastened by welding, at one of its ends, to the pipe 18 and assembled end to end, at its second end, to a pipe 19*b* for connecting the toroidal header 17. In this way, the water supply pipe 19, consisting of the sleeve 19*a* and of the pipe 19*b*, put the end part of the pipe 18 located outside the outer jacket of the steam generator in communication with the inner distribution volume of the toroidal collector 17. The emergency feed water supply pipe 19 is fed with emergency water, from the water reserve, by a channel connected to the end part of the pipe 18 located outside the outer jacket of the steam generator.

Thus a completely sealed junction is obtained for the supply pipe 19 and for the pipe 18, which makes it possible to prevent any leakage of cooling water between the pipe 18 and the water supply pipe 19. Such leaks could occur where a sleeve mounted so that it can slide inside the pipe penetrating the wall of the steam generator is used, for the purpose of avoiding the appearance of stresses due to differential expansions between the emergency feed water device and the outer jacket of the steam generator.

When a sleeve 19 secured, at one of its ends, to the pipe 18 is used, it is necessary to provide means of supporting the toroidal header of the emergency feed water device allowing movement under the effect of the differential expansions between the emergency feed device and the outer jacket of the steam generator.

Figure 8A:
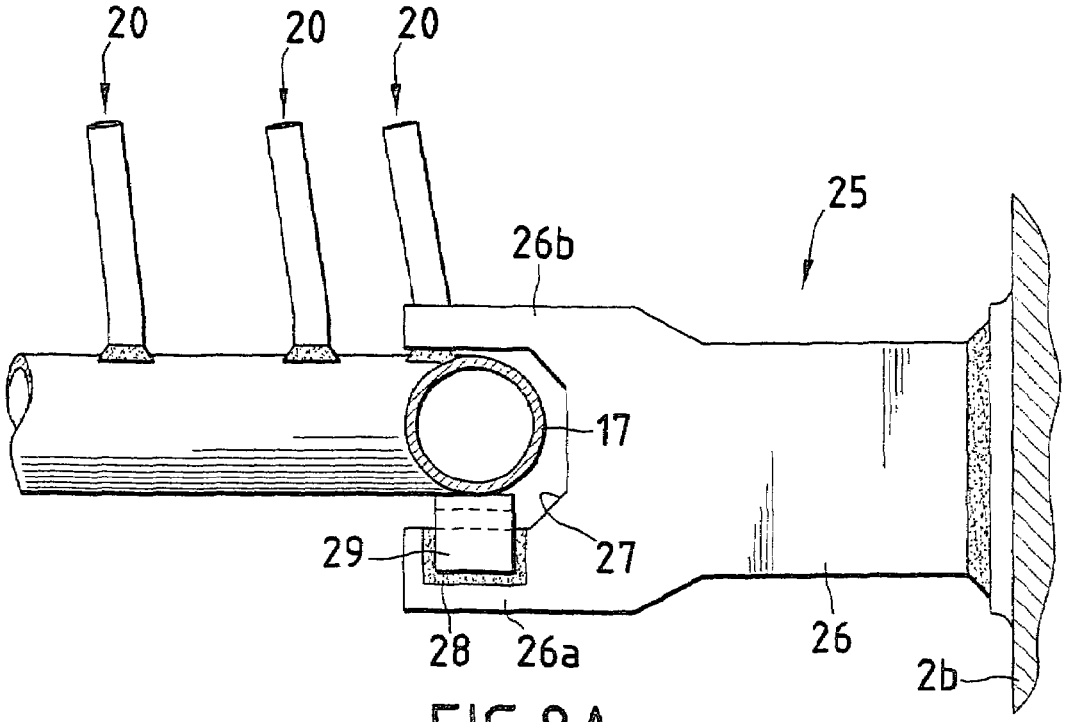
FIG. 8A is a partial view in elevation and in vertical section of the toroidal header for supplying emergency feed water and of a means of supporting the header inside the steam generator.
Figure 8B:
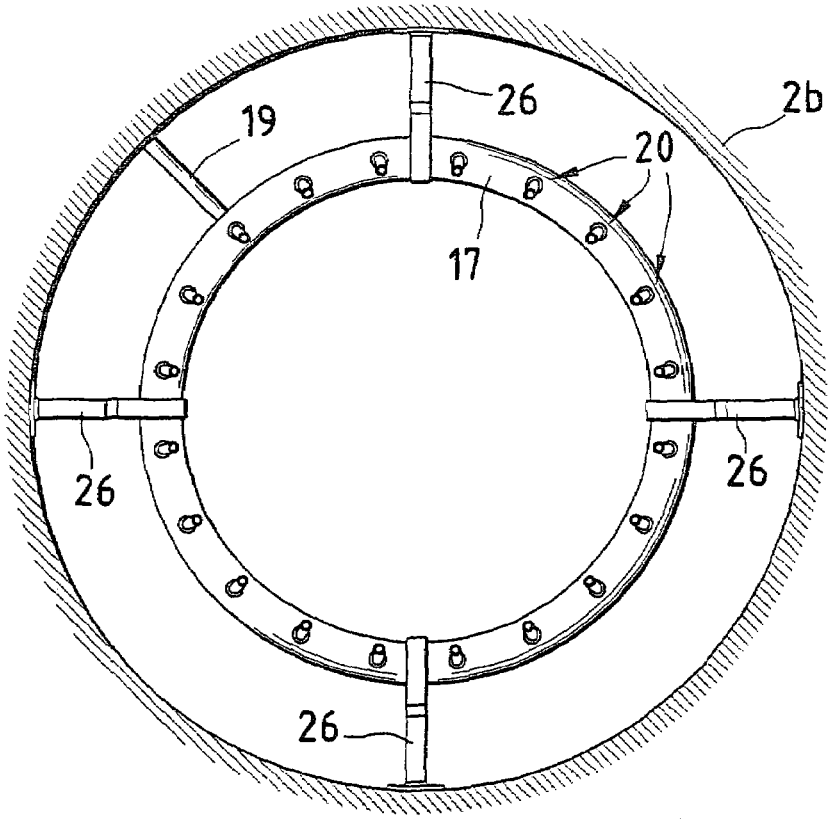
FIG. 8B is a top view of the toroidal header and of the support means for the header.

FIG. 8A shows a supporting means, generally denoted by the reference 25, which may be associated with other identical supporting means fastened along the inner periphery of the part 2*b* of the outer jacket of the steam generator in order to support the toroidal header 17 of the emergency feed water device while allowing movement due to the differential expansions between the emergency feed water device and the outer jacket of the steam generator, as shown in FIG. 8B.

FIG. 8A shows the supporting means 25 comprising a bracket 26 fastened by welding, in a horizontal direction, to the inner surface of the part 2*b* of the outer jacket of the steam generator, at the level intended for fastening the toroidal header 17.

At its end, the bracket 26 comprises a recess 27 whose height in the vertical direction is substantially greater than the diameter of the toroidal header 17. On each side of the recess 27, the bracket 26 comprises a lower supporting arm 26*a* and an upper arm 26*b*. A cavity 28 is machined in the inner surface of the lower arm 26*a* directed towards the recess 27, a cavity 28 intended to accommodate a wedge 29 which is fastened by welding in the cavity 28 and whose height can be calibrated such that, in the mounted position shown where the wedge 29 supports the toroidal header 17 by means of an upper bearing surface, there is a clearance in the vertical direction between the upper part of the toroidal header 17 resting on the wedge 29 and the inner surface of the arm 26*b* directed towards the recess 27.

As can be seen in FIG. 8B, for example four support brackets 26 arranged at 90° to each other on the inner circumference of the part 2*b* of the outer jacket of the steam generator can be provided.

The supporting device consisting of the brackets 26, at which the travel of the toroidal header 17 in the vertical direction and in the horizontal directions with respect to the edge of the recess 27 can be adjusted, allows expansion of the toroidal header 17 and movement with respect to the outer jacket of the steam generator both in the horizontal directions (radial direction of the toroidal header 17) and in the vertical direction.

Thus it is possible to reconcile a mounting with rigid fastening of one end of the water supply channel in the toroidal header 17 with respect to the outer jacket of the steam generator and movement due to the differential expansions between the toroidal header and the outer jacket of the steam generator during operation.

When supplying the inner volume of the toroidal header 17 with emergency feed water, the water introduced into the header is made to penetrate the openings in the upper part of the wall of the header in order to be distributed inside the volume of the part 14 of the steam generator by means of the water injection tubes 22 of the emergency water distribution devices 20.

The emergency water coming from the storage reservoir may accidentally convey foreign bodies whose introduction inside the bundle of the steam generator via the annular space 7 needs to be prevented.

Figure 4:
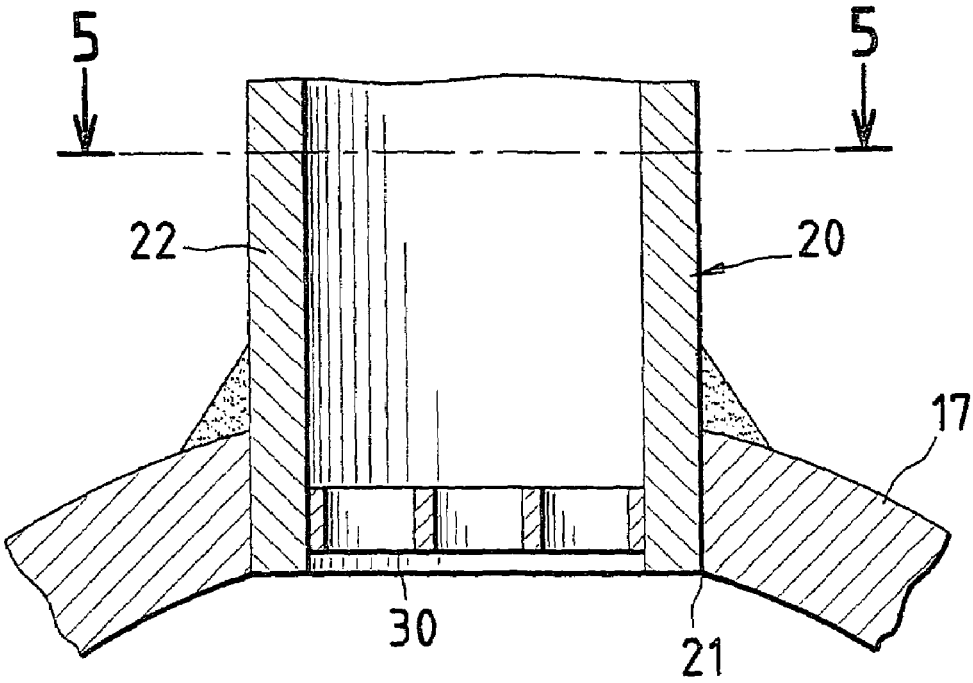
FIG. 4 is a view on a large scale and in section of part of a junction between a tube and the toroidal header of the emergency feed water device of the steam generator.
Figure 5:
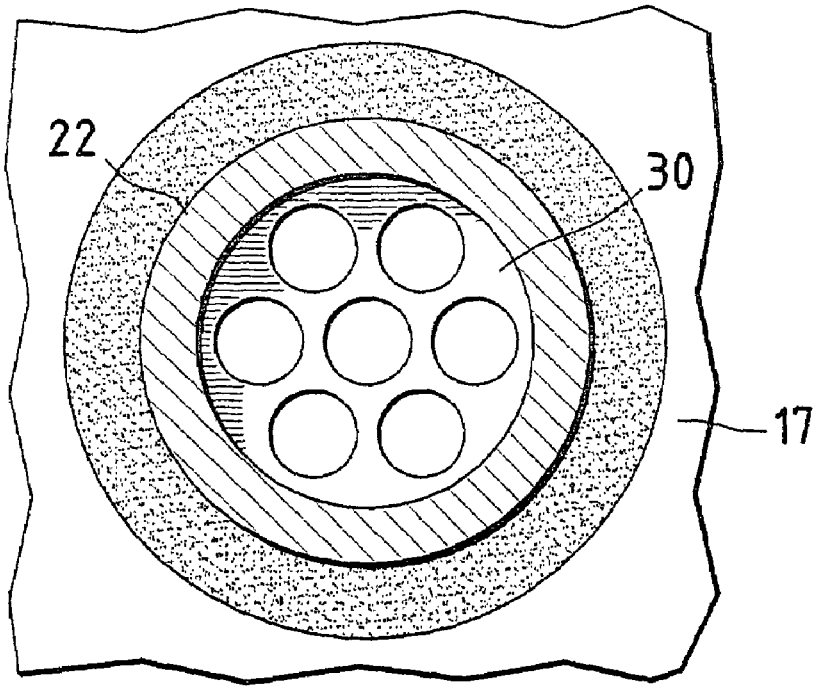
FIG. 5 is a view in section along 5-5 of FIG. 4.

For this purpose, as shown in FIGS. 4 and 5, a filter element 30, which may consist, for example, of a circular plate penetrated by openings with a circular cross section having a diameter equal to a characteristic dimension of the smallest debris or migrant bodies that it is required to trap, for example of about 4 mm, and making it possible to stop all debris having a dimension greater than 4 mm, is fastened in the lower part of each of the tubes 22 connected to the inner space of the toroidal header 17, inside an opening 21.

Debris with a size greater than 4 mm remains inside the toroidal header 17 and emergency feed water injected by the tubes 22 inside the upper part of the steam generator does not contain debris or migrant bodies which may be large enough to damage the tubes of the bundle.

Furthermore, the filter element 30 has the advantage of creating a slight pressure drop on the flow of emergency water and of making it possible more quickly to bring together the jets on the wall of the tubes 22 and consequently to decrease the length of the tubes 22.

The main advantage sought for the steam generator according to the invention comprising an emergency feed water device is to produce emergency water jets having a path inside the steam generator with enough length before the jet encounters a wall or internal equipment of the steam generator for the jet to be heated to a temperature close to the average temperature of the steam generator. In particular, a sought-after advantage is to avoid bringing the surface of the upper part of the outer wall of steam generator in contact with the low-temperature water capable of causing cracking of thermal origin. Within the scope of the example described, the toroidal header of the emergency feed water device of the generator according to the invention is placed in an area of the upper part of the steam generator not containing separating or drying devices and the jets of emergency feed water are injected into the steam generator by tubes which are slightly inclined towards the central axis of the steam generator. In this way, the jets, given the feed pressure of the emergency water, have a very long path, with no impact on equipment of the steam generator, before reaching the upper part of the bundle wrapper.

The height of the jets formed at the outlet of the tubes of the emergency feed device and the path of the jets may be controlled by adjusting the number and the diameter of the holes penetrating the upper wall of the toroidal header.

For example, for a steam generator of a pressurized-water nuclear reactor of recent design, it is possible to use a toroidal header of the emergency feed water device having an average radius greater than two meters, whose wall is drilled in its upper part with fifty holes having a diameter of 15 mm distributed over the circumference of the torus. In this case, it is possible to use tubes, each one fastened to the openings of the toroidal header, having a length of 150 mm and exhibiting a part inclined by 10° with respect to the vertical towards the inside of the steam generator.

The jets formed by the water penetrating the openings of the toroidal header may be subject to significant contraction, so that these jets may be detached from the inner wall of the tubes. In this case, in order to limit the height of the jets at the outlet of the tubes and in order for the jets to be joined back together inside the tubes, the number of holes can be increased or the diameter of the holes can be increased without changing the number thereof. However, it turned out that it was preferable not to increase the diameter of the holes significantly since the increased diameter of the jets resulted in less reheating of the water inside the steam formed in the upper part of the steam generator. As indicated above, it is also possible to create a slight pressure drop at the inlet of the tubes, for example by using a filter element as shown in FIGS. 4 and 5 which in addition makes it possible to trap the migrant bodies or debris contained in the emergency feed water.

The flow rate of the emergency feed water may be maintained in all cases at a value high enough to prevent any stratification effect inside the toroidal header according to the invention.

Furthermore, it is possible to prevent any risk of water hammer in the emergency feed device by providing a rising path for the emergency feed water from the inlet pipe in the steam generator up to the opposite end of the toroidal header. This inclination together with the presence of openings penetrating the wall of the toroidal header in its upper part makes it possible to discharge the steam which would have been able to form inside the toroidal header in phases where the emergency feed water device is not used.

The invention is not strictly limited to the embodiment which has been described. Thus provision can be made for an angle of inclination of the tubes with respect to the vertical towards the central part of the steam generator which differs by 10°, it being possible for this inclination advantageously to be between 5° and 20°. The tubes may have a different shape from the shape described. For example, the tubes may be completely straight tubes fastened in an inclined position with respect to the vertical in an opening penetrating the toroidal header near its upper part. For bent tubes as described with respect to FIGS. 3A and 3B, the first tube portion 22*a* is fastened in a vertical arrangement along an opening centred on the upper parallel circle of the toroidal jacket, while for a straight tube, this tube must be fastened in an inclined opening which is slightly offset (for example by 10° with respect to the vertical over the meridian section of the torus). In this case, the openings for passage of water of the toroidal header are not located at the highest point of the toroidal header, so that the steam can stay trapped in the toroidal header while it is filled at the time of commissioning the emergency feed water device, which could generate water hammer.

The invention is applicable to any steam generator requiring the use of an emergency feed water torus.

The steam generator according to the invention may comprise a first normal feed water device different from the device which has been described in and which comprises means for guiding the feed water consisting of a jacket arranged around part of the header and at least one guide wall extending the jacket downwards. In particular, the first header of the first normal feed water device of the steam generator may comprise water injection tubes fastened to the openings penetrating the toroidal header in its upper part. Such tubes may, for example, have the shape of a J so as to direct the feed water to the annular space of the steam generator. However, such an arrangement is less favourable than the device described above, in so far as the injection tubes extend the toroidal header upwards, such that the inner space of the upper part of the steam generator above the first feed device is not completely free to allow a path for the jets of the second emergency feed water device without interfering with the internal equipment of the steam generator, as for the example described.

In some cases, the main torus is in the cylindrical part of the outer jacket at a level which is generally higher than that of the main torus, as described above. In this case, the secondary torus may be placed either above the main torus, or below.

The invention claimed is:

1. Steam generator comprising an outer jacket (2) of generally cylindrical shape arranged with its vertical axis having a lower cylindrical part (2*a*) containing a bundle (3) of heat exchange tubes connected to a primary fluid circuit and arranged in a bundle wrapper (4) which is substantially coaxial with the outer jacket (2), an upper cylindrical part (2*b*) having a diameter greater than the diameter of the lower part (2*a*) in particular containing separators and steam dryers (15) and a part (2*c*) with a frustoconical junction between the lower part (2*a*) and the upper part (2*b*) of the outer jacket (2), at least a first and a second device (8, 16) for supplying feed water to an annular space (7) between the bundle wrapper (4) and one of a guide skirt (13) and the outer jacket (2), via the upper part of the annular space (7) which communicates with the inner space of the bundle wrapper (4) at its lower part, each one comprising a feed water distribution header (10, 17) in the annular space (7) arranged inside the outer jacket (2) having a toroidal wall substantially coaxial with the outer jacket (2) and with the bundle wrapper (4), the toroidal wall being penetrated by a plurality of openings for the passage of water into its upper part and at least one feed water supply pipe (9, 19) in a space inside the toroidal wall of the header (10, 17) penetrating the outer wall (2) of the steam generator (1), the first feed device (8) being used during normal operation of the steam generator (1) and the second feed device (16) being used in order to feed the steam generator (1) with emergency water, characterized in that the second toroidal header (17) of the second emergency feed water device (16) placed inside the upper part (2*b*) of the outer jacket (2) comprises, fastened to each of its openings (21) for the passage of water from its toroidal wall, a tube (22) for injecting water having an open lower end part (22*a*) fastened to the opening (21) of the toroidal wall, a straight part (22*b*) which is inclined with respect to the vertical axial direction in the direction of a central part of the steam generator (1) and an upper end open at the end of the straight part (22*b*) of the tube (22) for injecting emergency water inside the steam generator (1).

2. Steam generator according to claim 1, characterized in that the inclined straight part (22*b*) of each of the water injection tubes (22) makes an angle ($\alpha$) of between about 5° and about 20° and preferably an angle ($\alpha$) of roughly 10° with the vertical axial direction.

3. Steam generator according to claim 1, characterized in that the openings (21) penetrating the wall of the second toroidal header (17) of the second emergency feed water device (16) are circular openings centred on a circle parallel to the toroidal header (17) located close to the uppermost part of the wall of the toroidal header and that each of the emergency water injection tubes (22) comprises a first portion (22*a*) and a second portion (22*b*), the axes of which make a non-zero angle (α) between them, each of the emergency water injection tubes (22) being fastened by one end of its first portion (22*a*) to an opening (21) penetrating the wall of the second toroidal header (17).

4. Steam generator according to claim 1, characterized in that each of the emergency water injection tubes (22) in the steam generator comprises at least one support means (23) such as a cleat for fastening the water injection tube (22) by welding to the outer surface of the second toroidal header (17).

5. Steam generator according to claim 1, characterized in that each of the water injection tubes (22) comprises, in its lower end part fastened to the opening (21) of the second toroidal header (17), a device for trapping debris (30).

6. Steam generator according to claim 5, characterized in that the debris trapping device (30) consists of a circular plate having a diameter substantially equal to the inside diameter of the tube (22) and penetrated by openings having a dimension less than a characteristic dimension of the debris which it is desired to trap.

7. Steam generator according to any one of claims 1 to 6, characterized in that the feed water supply pipe (19) connected to the second header (17) by means of a first end comprises a second opposite end connected, for example by welding, to a pipe (18) penetrating the wall (2*b*) of the upper part of the steam generator.

8. Steam generator according to claim 7, characterized in that the second toroidal header (17) of the second emergency feed water device (16) is supported, inside the upper part (2*b*) of the outer jacket of the steam generator, by at least three brackets (26) fastened in radial arrangements over the inner surface of the upper part (2*b*) of the outer wall (2) of the steam generator, by a first end and comprising a second end directed towards the central part of the outer jacket of the steam generator comprising a recess (27) which is open in the direction of the central part of the outer jacket (2) of the steam generator, a first arm (26*a*) defining a lower part of the recess (27) and a second arm (26*b*) defining an upper part of the recess (27), a cavity (28) being made in an inner face of the lower arm (26*b*) in order to accommodate a wedge (29) for supporting the second toroidal header (27) with a clearance in the vertical direction and in the radial horizontal direction of each of the support brackets (26).

* * * * *